US006261668B1

(12) United States Patent
Nagy

(10) Patent No.: US 6,261,668 B1
(45) Date of Patent: Jul. 17, 2001

(54) KITCHEN CABINET COVER

(76) Inventor: Aranka Nagy, 1024 Coventry Pl. #B, Marysville, OH (US) 43040

( * ) Notice: Subject to any disclaimer, the term of this patent is extended or adjusted under 35 U.S.C. 154(b) by 0 days.

(21) Appl. No.: 09/301,734

(22) Filed: Apr. 29, 1999

(51) Int. Cl.[7] ..... B32B 7/12; B32B 3/02

(52) U.S. Cl. ..... 428/194; 428/40.1; 428/343; 428/904.4

(58) Field of Search ..... 428/194, 904.4, 428/192, 40.1, 343

(56) References Cited

U.S. PATENT DOCUMENTS

D. 275,326 * 8/1984 Bergsland ..... D25/94
732,889 * 7/1903 Paver ..... 428/194 X
1,707,515 * 4/1929 Evans ..... 428/194 X
2,030,135 * 2/1936 Carpenter ..... 428/194 X
2,096,351 * 10/1937 Semonsen ..... 428/194 X
2,130,359 * 9/1938 Miller ..... 154/2
3,922,408 * 11/1975 Smith ..... 428/40
5,070,966 * 12/1991 Brennan ..... 186/61
5,330,262 * 7/1994 Peters ..... 312/140.4
5,540,985 * 7/1996 Kennedy, Jr. ..... 428/282
5,776,572 * 7/1998 Lipson ..... 428/194 X

* cited by examiner

*Primary Examiner*—Daniel Zirker

(57) ABSTRACT

A kitchen cabinet cover for draping over drawers and cabinets below a countertop to shield the drawers and cabinets from water and food spills. The kitchen cabinet cover includes a flexible sheet with top and bottom faces, and a pair of end edges. The bottom face of the sheet has an adhesive thereon adjacent a first of the end edges of the sheet adapted for adhesion to a countertop.

2 Claims, 2 Drawing Sheets

KITCHEN CABINET COVER

BACKGROUND OF THE INVENTION

1. Field of the Invention

The present invention relates to cabinet covers and more particularly pertains to a new kitchen cabinet cover for draping over drawers and cabinets below a countertop to shield the drawers and cabinets from water and food spills.

2. Description of the Prior Art

The use of cabinet covers is known in the prior art. More specifically, cabinet covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,070,966; 5,540,985; 5,330,262; 2,130,359; U.S. Pat. No. Des. 275,326; and U.S. Pat. No. 3,922,408.

While these devices fulfill their respective, particular objectives and requirements, the aforementioned patents do not disclose a new kitchen cabinet cover. The inventive device includes a flexible sheet with top and bottom faces, and a pair of end edges. The bottom face of the sheet has an adhesive thereon adjacent a first of the end edges of the sheet adapted for adhesion to a countertop.

In these respects, the kitchen cabinet cover according to the present invention substantially departs from the conventional concepts and designs of the prior art, and in so doing provides an apparatus primarily developed for the purpose of draping over drawers and cabinets below a countertop to shield the drawers and cabinets from water and food spills.

SUMMARY OF THE INVENTION

In view of the foregoing disadvantages inherent in the known types of cabinet covers now present in the prior art, the present invention provides a new kitchen cabinet cover construction wherein the same can be utilized for draping over drawers and cabinets below a countertop to shield the drawers and cabinets from water and food spills.

The general purpose of the present invention, which will be described subsequently in greater detail, is to provide a new kitchen cabinet cover apparatus and method which has many of the advantages of the cabinet covers mentioned heretofore and many novel features that result in a new kitchen cabinet cover which is not anticipated, rendered obvious, suggested, or even implied by any of the prior art cabinet covers, either alone or in any combination thereof.

To attain this, the present invention generally comprises a flexible sheet with top and bottom faces, and a pair of end edges. The bottom face of the sheet has an adhesive thereon adjacent a first of the end edges of the sheet adapted for adhesion to a countertop.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new kitchen cabinet cover apparatus and method which has many of the advantages of the cabinet covers mentioned heretofore and many novel features that result in a new kitchen cabinet cover which is not anticipated, rendered obvious, suggested, or even implied by any of the prior art cabinet covers, either alone or in any combination thereof.

It is another object of the present invention to provide a new kitchen cabinet cover which may be easily and efficiently manufactured and marketed.

It is a further object of the present invention to provide a new kitchen cabinet cover which is of a durable and reliable construction.

An even further object of the present invention is to provide a new kitchen cabinet cover which is susceptible of a low cost of manufacture with regard to both materials and labor, and which accordingly is then susceptible of low prices of sale to the consuming public, thereby making such kitchen cabinet cover economically available to the buying public.

Still yet another object of the present invention is to provide a new kitchen cabinet cover which provides in the apparatuses and methods of the prior art some of the advantages thereof, while simultaneously overcoming some of the disadvantages normally associated therewith.

Still another object of the present invention is to provide a new kitchen cabinet cover for draping over drawers and cabinets below a countertop to shield the drawers and cabinets from water and food spills.

Yet another object of the present invention is to provide a new kitchen cabinet cover which includes a flexible sheet with top and bottom faces, and a pair of end edges. The bottom face of the sheet has an adhesive thereon adjacent a first of the end edges of the sheet adapted for adhesion to a countertop.

Still yet another object of the present invention is to provide a new kitchen cabinet cover that attaches to a countertop to cover a portion of the countertop so that the countertop is also shielded from soiling and staining and for protecting bacteria and other germ build up on the countertop.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
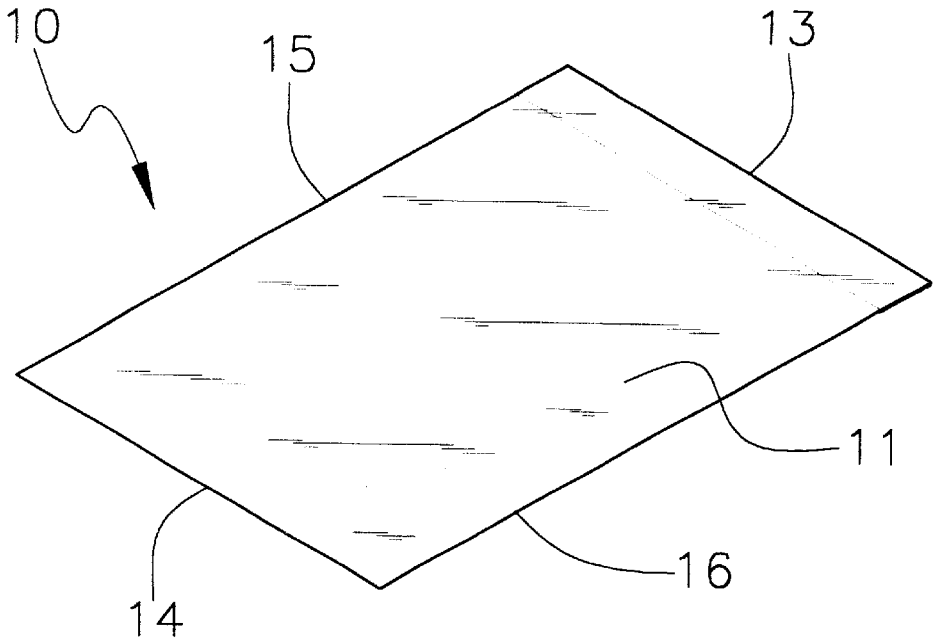
FIG. 1 is a schematic top perspective view of a new kitchen cabinet cover according to the present invention.
Figure 2:
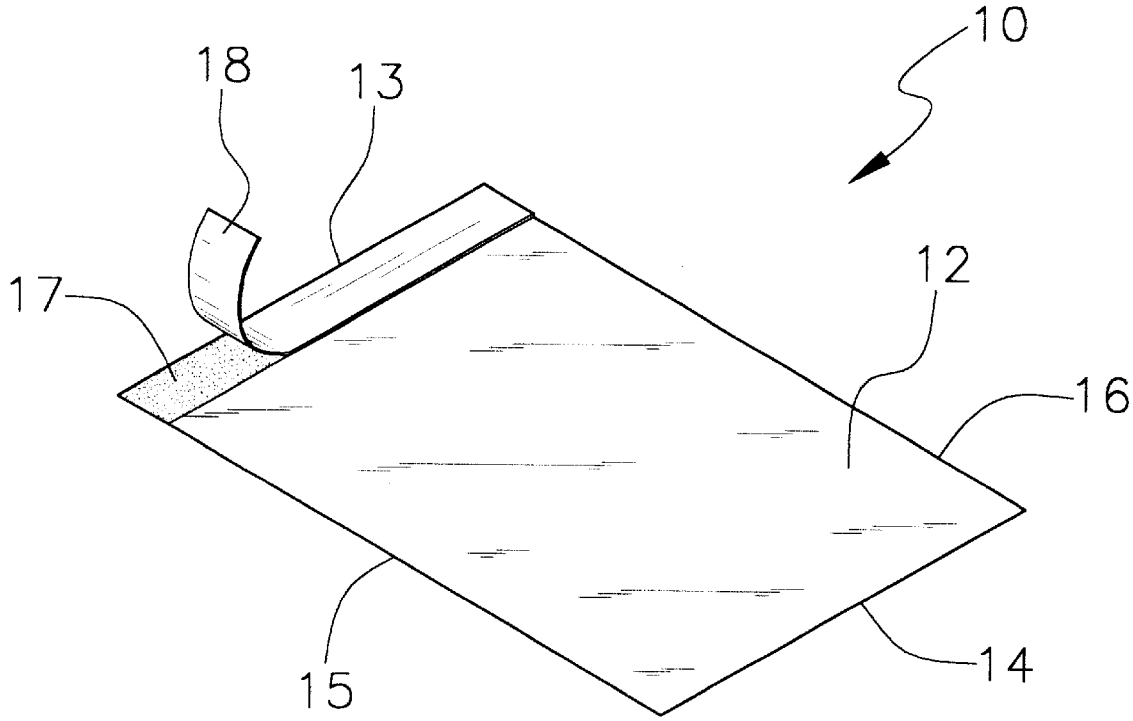
FIG. 2 is a schematic bottom perspective view of the present invention.
Figure 3:
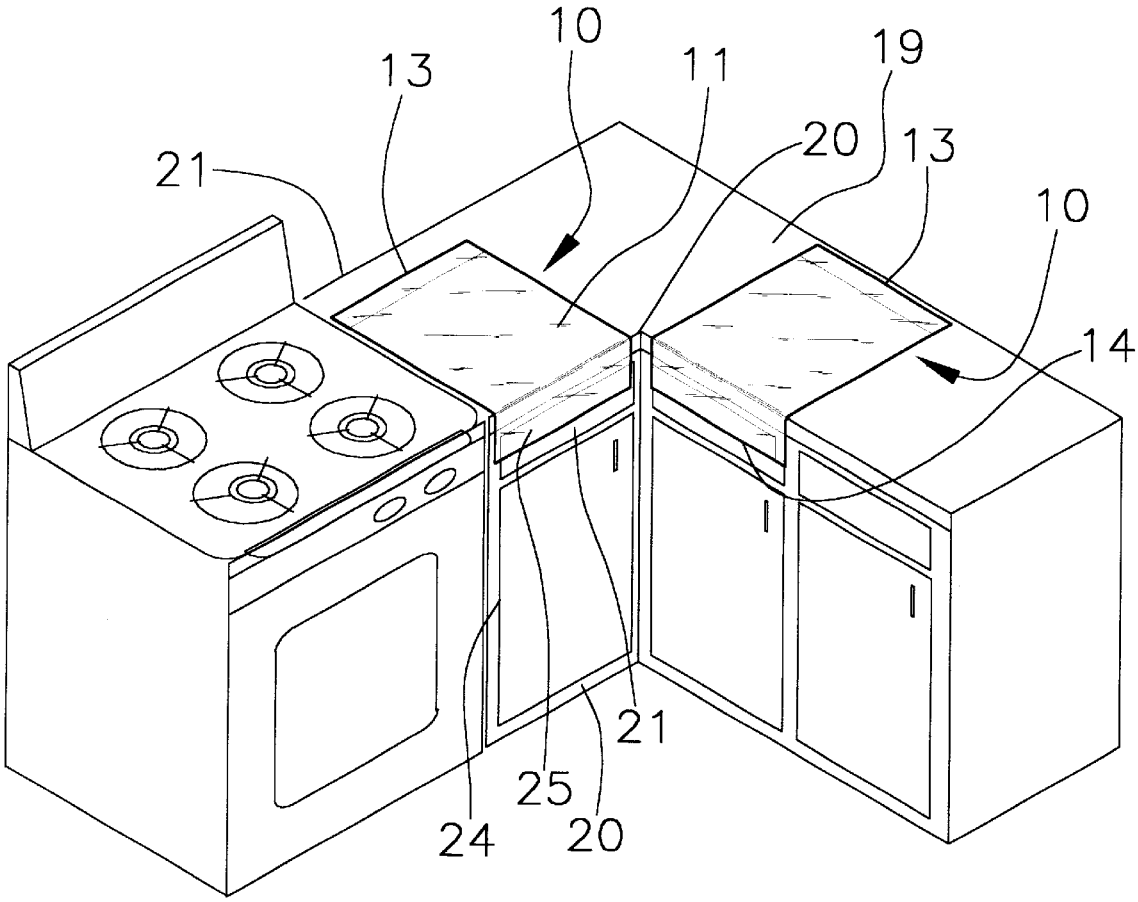
FIG. 3 is a schematic perspective view of the present invention in use.

With reference now to the drawings, and in particular to FIGS. 1 through 3 thereof, a new kitchen cabinet cover embodying the principles and concepts of the present invention will be described.

As best illustrated in FIGS. 1 through 3, the kitchen cabinet cover generally comprises a flexible sheet with top and bottom faces, and a pair of end edges. The bottom face of the sheet has an adhesive thereon adjacent a first of the end edges of the sheet adapted for adhesion to a countertop.

In closer detail, the kitchen cabinet cover comprises a preferably generally rectangular thin flexible sheet 10 (although it should be recognized that the sheet may be any other desired shape) having generally rectangular top and bottom faces 11,12, and a generally rectangular, outer perimeter comprising a pair of substantially straight end edges 13,14 and a pair of substantially straight side edges 15,16 extending between the end edges. The end edges of the sheet are preferably extended substantially parallel to one another. The side edges of the sheet are preferably extended substantially parallel to one another and substantially perpendicular to the end edges of the sheet.

The sheet preferably comprises a translucent material and ideally a transparent material to permit a user to see through the sheet. The sheet also preferably comprises a water impermeable material to prevent the passage of water and other water based fluids through the sheet. Optimally, the sheet comprises a translucent, water impermeable plastic material.

The sheet has a thickness defined between the top and bottom faces of the sheet, a length defined between the end edges of the sheet and a width defined between the side edges of the sheet. In an ideal illustrative embodiment, the thickness of the sheet is preferably about 1 mm, the length of the sheet is preferably about 36 inches, and the width of the sheet is preferably about 24 inches for providing an optimal amount of coverage for covering most standard sized countertops.

As best illustrated in FIG. 2, the bottom face of the sheet has an adhesive 17 thereon. The adhesive is preferably provided in a generally rectangular strip extending between the side edges of the sheet adjacent or along a first of the end edges 13 of the sheet. The strip of adhesive has a length defined between the side edges of the sheet and a width defined from the first end edge of the sheet and substantially perpendicular to the length of the protective strip. Preferably, the length of the strip of adhesive is about equal to the width of the sheet and , the width of the strip of adhesive is between about ¼ inch and about 3 inches to ensure adequate adhesion of the bottom face of the sheet to a surface. Ideally, the width of the strip of adhesive is about 1 inch for providing an optimal adhesion of the bottom of the sheet to a surface.

A generally rectangular peelably removable protective strip 18 covers the adhesive and is removed prior to adhesion. The protective strip preferably has dimension about equal to the dimensions of the strip of adhesive. The protective strip is lightly adhered to the adhesive and preferably comprises a wax-paper material (or has a wax paper material face in contact with the adhesive) so that removal of the protective strip from the adhesive does not remove any or much of the adhesive from the bottom face of the sheet.

With reference to FIG. 3, the kitchen cabinet cover is designed for use with a substantially planar countertop 19 (such as a kitchen or bathroom countertop) having at least one cabinet 20 and/or drawer 21 therebelow. The countertop has front and back edges 22,23. The cabinet has a cabinet door 24 positioned adjacently below the front edge of the countertop. If drawers are present, the front of the drawers are also positioned adjacently below the front edge of the countertop. The front edge 22 of the countertop may also have an overhang extending forwards from the vertical plane in which the cabinet doors and drawer fronts lie.

As shown in FIG. 3, the sheet is rested on the countertop with the bottom face of sheet facing the upper surface of the countertop. The adhesive of the sheet adhesively couples the bottom face of the sheet to the upper surface of the countertop to hold the sheet in place on the countertop. The first end edge 13 of the sheet is positioned towards the back edge 23 of the countertop with the side edges of the sheet preferably extended generally perpendicular to the front edge of the countertop.

A second of the end edges 14 of the sheet is draped over the front edge of the countertop such that a generally rectangular end portion 25 of the sheet adjacent the second end edge of the sheet downwardly depends (that is, hangs) from the front edge of the sheet over a portion of the cabinet door and/or drawer to protect the cabinet door and/or drawer. The end portion of the sheet has a width defined parallel to the length of the sheet. Preferably, the width of the end portion of the sheet is between about one-sixth and about one-half the length. Ideally, the width of the end portion is between about one-fifth and about one-fourth the length of the sheet so that an adequate amount of the sheet hangs down over the front edge of the countertop to provide adequate protection to the cabinet drawers from water and food spills and runoffs from the countertop.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A countertop and cabinet cover system, comprising:

a flexible sheet having top and bottom faces, and a pair of end edges;

said bottom face of said sheet having an adhesive thereon adjacent a first of said end edges of said sheet;

wherein said sheet has a pair of side edges extending between said end edges of said sheet, wherein said end edges of said sheet are extended substantially parallel to one another and said side edges of said sheet are extended substantially parallel to one another and substantially perpendicular to said end edges of said sheet;

wherein said adhesive is provided in a generally rectangular strip extending between said side edges of said sheet adjacent said first end edge of said sheet;

a removable protective strip covering said adhesive;

wherein said sheet comprises a translucent material;

wherein said sheet comprises a water impermeable material;

said sheet having a thickness defined between said top and bottom faces of said sheet, a length defined between said end edges of said sheet and a width defined between said side edges of said sheet;

wherein said thickness of said sheet is about 1 mm, said length of said sheet is about 36 inches, and said width if said sheet is about 24 inches for providing an optimal amount of coverage; and said length of said strip of adhesive being about equal to said width of said sheet, said width of said strip of adhesive being between about ¼ inches and about 3 inches to facilitate adequate adhesion of said bottom face of said sheet to a surface.

2. A countertop and cabinet cover system, comprising:

a flexible sheet having generally rectangular top and bottom faces, and a generally rectangular outer perimeter a pair of substantially straight side edges extending between said end edges;

said end edges of said sheet being extended substantially parallel to one another, said side edges of said sheet being extended substantially parallel to one another and substantially perpendicular to said end edges of said sheet;

said sheet comprising a translucent material, wherein said sheet comprises a water impermeable material;

said sheet having a length defined between said end edges of said sheet and a width defined between said side edges of said sheet;

said bottom face of said sheet having an adhesive thereon, said adhesive being provided in a generally rectangular strip extending between said side edges of said sheet adjacent a first of said end edges of said sheet;

said strip of adhesive having a length defined between said side edges of said sheet and a width defined from said first end edge of said sheet and substantially perpendicular to said length of said protective strip;

said length of said strip of adhesive being about equal to said width of said sheet, said width of said strip of adhesive being between about ¼ inch and about 3 inches;

a substantially planar countertop having at least one cabinet therebelow, said countertop having front and back edges, said cabinet having a cabinet door positioned adjacent said front edge of said countertop;

said sheet being rested on said countertop, said bottom face of sheet facing said countertop, said adhesive of said sheet adhesively coupling said bottom face of said sheet to said countertop;

said first end edge of said sheet being positioned towards said back edge of said countertop, said side edges of said sheet being extended generally perpendicular to said front edge of said countertop;

a second of said end edges of said sheet being draped over said front edge of said countertop such that a generally rectangular end portion of said sheet adjacent said second end edge of said sheet downwardly depends from said front edge of said sheet over a portion of said cabinet door; and said end portion of said sheet having a width defined parallel to said length of said sheet, wherein said width of said end portion of said sheet is between about one-sixth and about one-half said length.

* * * * *